US005180055A

United States Patent [19]

Chance et al.

[11] Patent Number: 5,180,055

[45] Date of Patent: Jan. 19, 1993

[54] METHOD OF ATTACHING TWO HALF-CARTONS AND THE PRODUCT

[75] Inventors: Christopher N. Chance, Richmond; James A. DeBlasio, Midlothian; Donald H. Evers, Richmond; William C. Harris, Jr., Midlothian; Michael A. Kirby, Sr., Trevilians; Reginald W. Newsome, Richmond; Robert E. Talley, Chester, all of Va.

[73] Assignee: Philip Morris Incorporated, New York, N.Y.

[21] Appl. No.: 901,677

[22] Filed: Jun. 22, 1992

Related U.S. Application Data

[63] Continuation-in-part of Ser. No. 774,529, Oct. 8, 1991, Pat. No. 5,141,106.

[51] Int. Cl.[5] ..... B65D 5/00; B65D 85/10; B65B 51/08

[52] U.S. Cl. ..... 206/256; 206/273; 206/813; 229/120.011; 53/412; 53/416; 53/448

[58] Field of Search ..... 206/813, 256, 273; 229/120.011; 53/412, 416, 419, 444, 448, 449

[56] References Cited

U.S. PATENT DOCUMENTS

| | | | |
|---|---|---|---|
| 1,567,165 | 12/1925 | Noland | 229/120.01 |
| 3,113,673 | 12/1963 | Stein | 229/120.011 |
| 3,160,341 | 12/1969 | Cherney | 206/813 |
| 3,404,825 | 10/1968 | Rumberger | 229/120.01 |

FOREIGN PATENT DOCUMENTS

| | | | |
|---|---|---|---|
| 358560 | 10/1931 | United Kingdom | 206/256 |

*Primary Examiner*—William I. Price
*Attorney, Agent, or Firm*—Jeffrey H. Ingerman

[57] ABSTRACT

A method of attaching two containers wherein a releasable attachment insert is placed during assembly between the side walls and side flaps at each end of two containers faced toward each other, and the dual container structure formed thereby. The insert acts to securely attach the two containers such that they may easily be separated for later sale as independent units.

15 Claims, 4 Drawing Sheets

METHOD OF ATTACHING TWO HALF-CARTONS AND THE PRODUCT

CROSS REFERENCE TO RELATED APPLICATION

This application is a continuation-in-part of copending, commonly-assigned U.S. patent application Ser. No. 07/774,529, filed Oct. 8, 1991, now U.S. Pat. No. 5,141,106 which is hereby incorporated by reference in its entirety.

BACKGROUND OF THE INVENTION

This invention relates to a method of attaching two half-cartons to form a dual half-carton structure. More particularly, this invention relates to a method of attaching paperboard half-cartons of cigarette packs, wherein two half-cartons may be secured together, run as a single carton through a standard tax-stamping machine and later separated for sale as individual half-carton units.

Cigarettes are commonly sold in paperboard cartons of ten cigarette packs, each pack containing about twenty to twenty-five cigarettes. Due to the rising costs of cigarettes, it has become desirable to make available to consumers half-cartons of five cigarette packs in addition to the standard ten-pack full cartons.

Standard cigarette cartons contain two parallel rows of five packs each. In each row of the carton, the five packs are typically positioned with their tops facing upward and aligned side-by-side in a 1×5 pack configuration. Two such rows form a standard 2×5 pack carton. Each 1×5 pack row may be packaged separately for sale as a five pack half-carton.

Most states and foreign countries require that tax stamps be affixed to cigarette packs prior to sale. Existing automated tax-stamping machines are geared for simultaneously stamping ten cigarette packs in the standard 2×5 pack carton configuration. Accordingly, in order to use existing tax-stamping machines, separately packaged half-cartons must be configured in parallel pairs such that two half-cartons may be sent through a standard tax-stamping machine as a single 2×5 pack carton unit.

The two half-cartons, however, must be held together securely and without slipping to ensure that the tax-stamping machine will function properly. In addition, the half-cartons must be easily separable so that each half-carton may be sold by itself at the retail level.

One prior method of packaging two half-cartons for tax-stamping involved inserting two separate half-cartons into a standard 2×5 pack full carton container to facilitate tax-stamping on existing full carton tax-stamping equipment. This packaging scheme, however, was carried out primarily by hand and required significant effort at the retail level to separate the two half-cartons from the full carton container for separate sale.

Another prior method for packaging the two half-cartons for tax-stamping involved a 2×5 pack full carton that could be separated into two 1×5 pack half-cartons by tearing along a perforation. There are many variations of this perforation method, each with its own particular advantage. Still, a method that requires tearing may not always work properly because separation of the two half-cartons by tearing one from the other, even along perforations, depends on the manual dexterity of the retailer or consumer doing the tearing and could result in misplaced tearing, crushing, folding or detachment of carton walls or flaps, or other deformations of the carton structure.

It is desirable to provide an improved method of packaging cigarette cartons that makes use of existing machinery for tax-stamping of cartons and requires minimal modifications of existing machinery for making half-cartons and for placing cigarette packs into them.

It is also desirable to provide an improved method of packaging two half-cartons of cigarettes so that they may be securely paired together for tax-stamping in a standard tax-stamping machine and later may be easily separated at the retail level to enable the consumer to purchase only a half-carton rather than a full carton.

It is further desirable to provide an improved method of packaging cigarette cartons so that two half-cartons may be cleanly separated at the retail level without crushing, folding, tearing or otherwise deforming any part of the carton.

SUMMARY OF THE INVENTION

It is an object of this invention to provide an improved method of packaging cigarette cartons that makes use of existing machinery for tax-stamping of cartons and requires minimal modifications of machinery for making half-cartons and for placing cigarette packs into them.

It is another object of this invention to provide an improved method of packaging cigarette cartons so that two half-cartons may be held securely together for tax-stamping in a standard tax-stamping machine and later either may remain securely together or may be separated at the consumer's option at the retail level.

It is a further object of this invention to provide an improved method of packaging cigarette cartons so that two half-cartons may be separated, if desired, at the retail level without crushing, folding, tearing or otherwise deforming any part of the carton.

These and other objects of the invention are accomplished by folding two half-carton blanks into two half-cartons and positioning them so that the front wall of one abuts the front wall of the other to form a dual half-carton structure. During assembly, a releasable attachment means is placed at each end of the dual half-carton structure at least partially between the side flap and side wall of each half-carton. The side walls of each container are then adhered in the conventional assembly manner to the side flaps, but without being adhered to the releasable attachment means at the same time. In this manner, the two half-cartons are secured one to another at both ends by the two releasable attachment means so that the two half-cartons may pass through and be tax-stamped in existing tax-stamping machines. Later, if the consumer chooses to purchase a full carton, the two half-cartons will remain securely together due to the presence of the releasable attachment means. If the consumer chooses to purchase only a half-carton, the two half-cartons may be easily separated without crushing, folding, tearing or otherwise deforming the carton, merely by pulling the half-cartons away from each other. The pulling action will cause the releasable attachment means to release their hold on the two half-cartons and allow the half-cartons to separate for sale as two half-carton units. The releasable attachment means may then be discarded.

BRIEF DESCRIPTION OF THE DRAWINGS

The above and other objects and advantages of the invention will be apparent upon consideration of the following detailed description, taken in conjunction with the accompanying drawings, in which the reference characters refer to like parts throughout and in which.

DETAILED DESCRIPTION OF THE INVENTION

In the preferred embodiment of the present invention, two paperboard blanks are folded into two half-cartons in the conventional manner and placed so that their front walls abut each other. Before the side walls of the half-cartons are glued to the side flaps, one releasable attachment means, hereafter called a slip-lock insert, is placed at each end of the two half-cartons. At each end, one slip-lock insert is placed between the side wall and side flap of each half-carton. The side walls and side flaps are then glued to each other where the slip-lock inserts do not separate them, so that the slip-lock inserts are not permanently glued in place.

The slip-lock insert is preferably a paperboard section having on both sides a releasable tacky adhesive or any other means for securely attaching the two half-cartons while allowing them to be pulled apart without difficulty. When the half-cartons are pulled apart, the slip-lock inserts release their hold on the half-cartons and may then be discarded.

Figure 1:
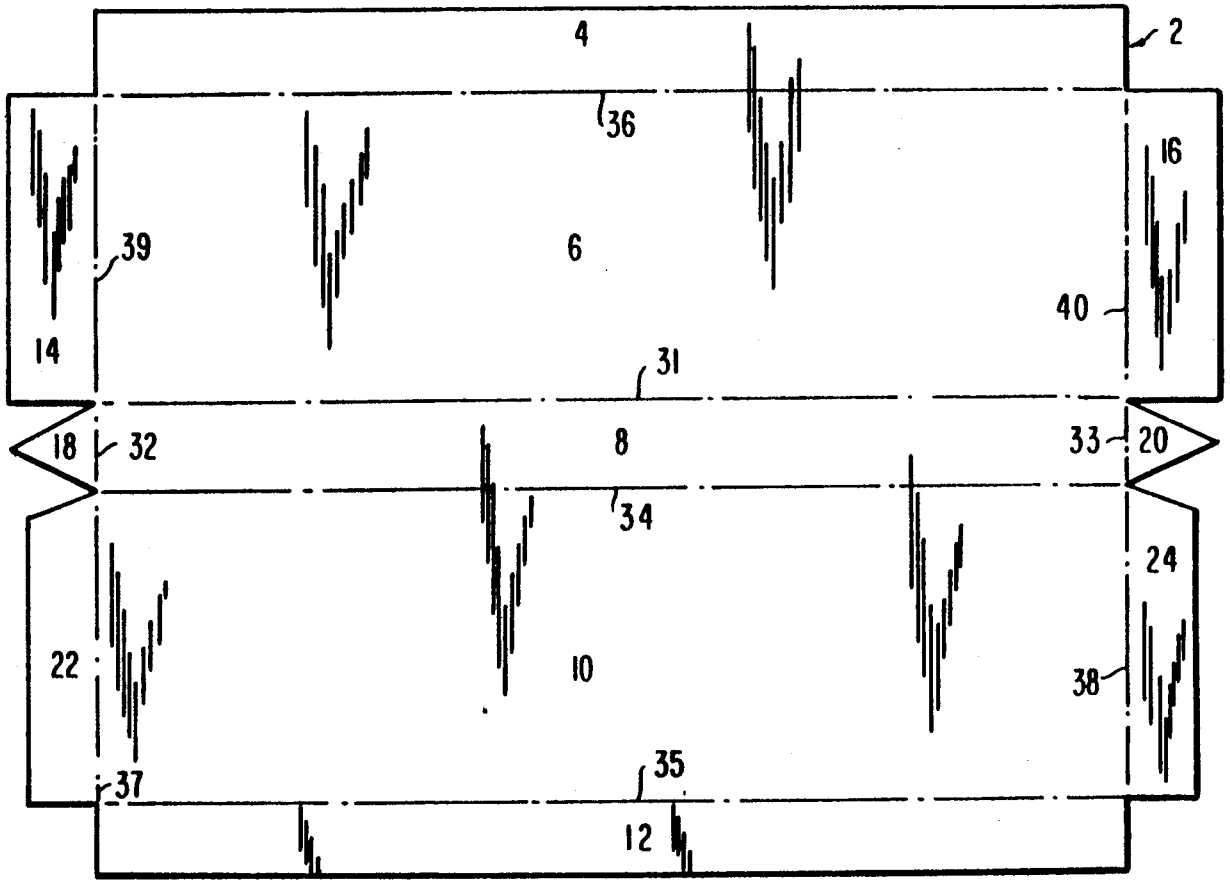
FIG. 1 shows a single blank of paperboard that, when folded along the dashed fold lines, forms a half-carton containing five cigarette packs aligned side-by-side.

In a preferred embodiment of this invention, a blank 2 of paperboard is fabricated as shown in FIG. 1. The different sections of the blank are separated from each other by scored fold lines, indicated in FIG. i by dashed lines 31–40. These score lines are formed by any known means in the art. One half-carton is formed by folding along the dashed fold lines of FIG. 1.

The half-carton blank 2 is folded along the fold lines 31–40 to encase five cigarette packs aligned in the side-by-side 1×5 pack configuration. The bottoms of the five cigarette packs will rest along bottom wall 8. Back wall 6, attached top flap 4 and attached side walls !4 and !6 are folded up along fold line 31 so that back wall 6 rests against the back walls of the five cigarette packs. Bottom flaps 18 and 20 are folded up along fold lines 32 and 33 to rest against the outer side walls of the two cigarette packs at the ends of the 1×5 pack group. Front wall 10, attached top flap 12 and attached side flaps 22 and 24 are folded up along fold line 34 so that front wall 10 rests against the front walls of the five cigarette packs. Top flaps 12 and 4 may be folded down along fold lines 35 and 36 so that they rest on the tops of the five cigarette packs.

Those skilled in the art will understand that the half-carton need not actually be folded around five cigarette packs but rather may be formed hollow, such that the five cigarette packs may be inserted into the empty half-carton later.

Normally, to complete the half-carton structure, first side flaps 22 and 24 and then side walls 14 and 16 are folded in to rest against the outer side walls of the two cigarette packs at the ends of the 1×5 pack configuration. Then, by any known means, side walls 14 and 16 are glued to bottom flaps 18 and 20 and to side flaps 22 and 24. In the preferred embodiment of the present invention, the immediate gluing of the half-carton is delayed to facilitate the insertion of the slip-lock inserts.

Figure 2:
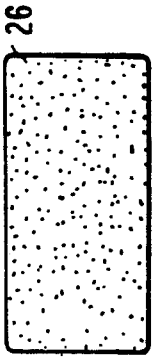
FIG. 2 shows a top view of an unattached releasable attachment means.

As shown in FIG. 2, slip-lock insert 26 is preferably a rectangular shaped paperboard section whose width, in this embodiment, is no greater than twice the width of a carton side wall 14 or 16 and whose height, in this embodiment, is substantially smaller than that of the half-cartons to be adhered. In the preferred embodiment, the slip-lock insert is gummed on both its sides with a preapplied releasable tacky adhesive. The tacky surfaces cause the slip-lock insert to adhere between the side flaps 22, 24 and side walls 14, 16 at each end of the two half-cartons, thereby holding the two half-cartons together. The tacky adhesive, therefore, should preferably be of the type that will permit non-permanent adhesion of the slip-lock insert to the side walls and side flaps. However, the tacky material should preferably not be so strong as to prevent separation of the two half-cartons when being pulled apart. Those skilled in the art will understand that many types of glue, tape or adhesive may be used on this slip-lock insert and that the slip-lock insert may be of other shapes or sizes that accomplish the same purpose.

Other releasable attachment means are possible to releasably attach the two half-cartons to each other. For example, a ratchet-like structure that uses vertically oriented grooves die-embossed into both the slip-lock insert and each of the half-carton's two side walls may be provided. The grooves on the slip-lock insert and on the half-carton side walls cooperate as an interlocking ratchet to attach the two half-cartons at each of their ends and to release the attachment when the half-cartons are pulled apart. Alternatively, the vertically oriented grooves may be die-embossed into the side flaps as well as the side walls such that the grooves on the slip-lock insert cooperate with the grooves on both the side walls and the side flaps to attach the two half-cartons to each other. Other releasable attachment means may be provided by those skilled in the art.

Figure 3:
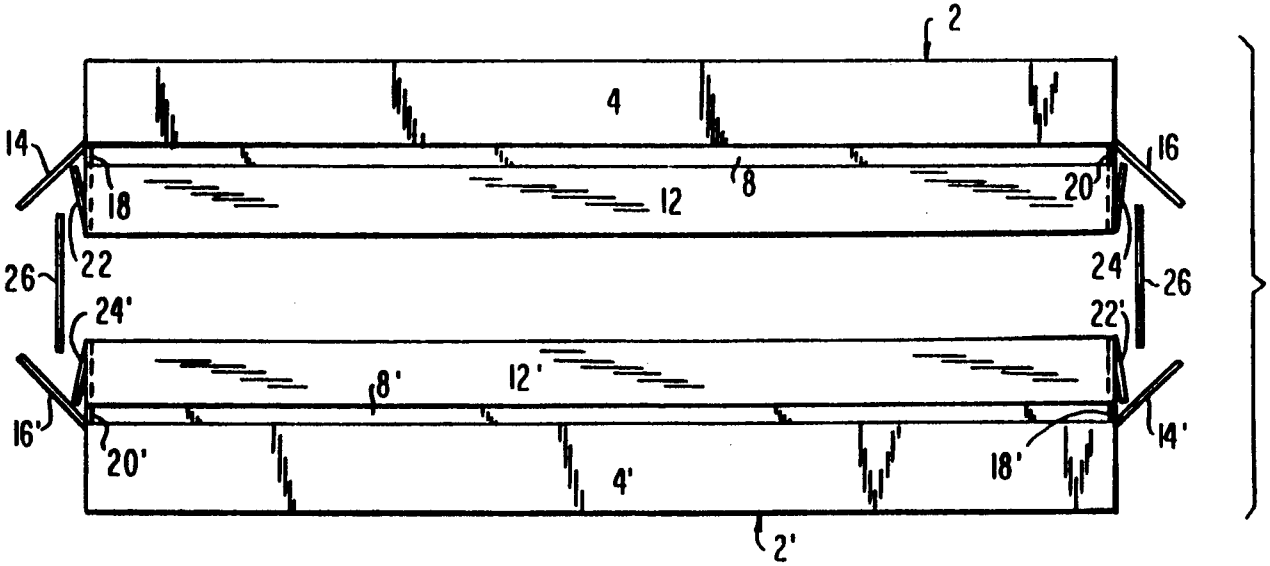
FIG. 3 shows a top view of two partially assembled half-cartons positioned in parallel for attachment.

FIG. 3 shows two half-carton blanks 2 and 2' folded as described earlier and positioned for attachment as a dual half-carton unit. Folded half-carton blanks 2 and 2' should preferably be identical and formed from the same blank shown in FIG. 1, so that each half-carton part in FIGS. 2–6 is identified by the same reference numeral used in the half-carton blank in FIG. 1, except that the prime designation ("'") is used when referring to the folded blank 2'. In FIG. 3, a folded half-carton blank 2' has been rotated 180° so that front wall 10' abuts front wall 10. Top flaps 4, 4' have been folded back away from the tops of the five cigarette packs in the half-cartons.

In constructing the dual half-carton unit from folded blanks 2 and 2', the side flaps 22 and 24 of each half-carton blank must first be folded against the side walls of the two cigarette packs at the ends of each 1×5 pack group. Then, a slip-lock insert 26 with gummed surfaces is placed over and adhered to side flaps 22 and 24 at each end of the dual half-carton unit. In other words, at one end, an insert is placed over and adhered to side flap 22 and side flap 24' while, at the other end, an insert is placed over and adhered to side flap 24 and side flap 22'. The slip-lock insert will adhere to the side flaps by virtue of the tacky surfaces of the insert.

Then, at each end of the dual half-carton unit, side walls 14 and 16 are folded against the sides of the 1×5 pack units, releasably adhered to the slip-lock inserts by the releasable adhesive and permanently adhered by other means to side flaps 22 and 24 and to bottom flaps 18 and 20. This permanent adhering of side walls 14 and 16 at each end of the dual half-carton unit to side flaps 22 and 24 and to bottom flaps 18 and 20 is typically done with permanent glue but may be accomplished with any other known means, including tape or other permanent adhesives. However, the permanent adhesive must be placed above and below the slip-lock insert so that the adhesive glues side walls 14 and 16 only to the side and bottom flaps but not to the slip-lock insert 26. The slip-lock insert 26 remains firmly in position by virtue of its own tacky surfaces. Adhering of the slip-lock inserts 26 to the side walls by means other than the tacky surfaces of the slip-lock inserts (or whatever alternative releasable attachment means is provided) will undesirably prevent the slip-lock inserts from being subsequently detached.

Figure 4:
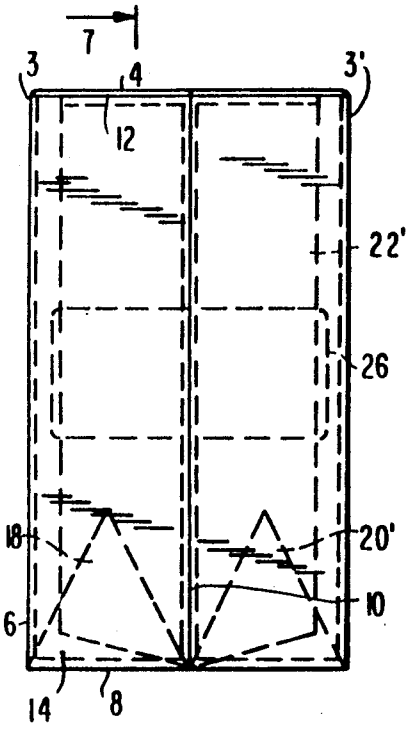
FIG. 4 shows a side elevational view of two half-cartons attached by two releasable attachment means forming a full carton structure.
Figure 7:
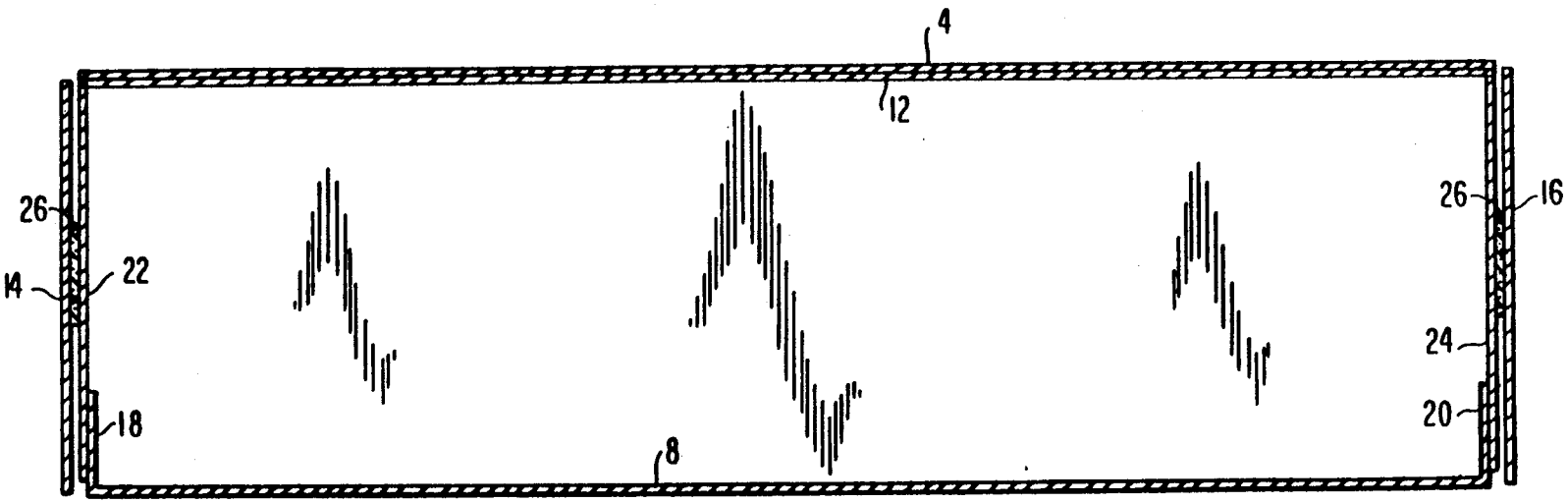
FIG. 7 shows a partially exploded vertical cross-sectional view of two half-cartons attached by two releasable attachment means taken along line 7—7 of FIG. 4.

On the resulting completed dual half-carton unit, one gummed slip-lock insert rests between and adheres to the side wall and the side flap at each end of each half-carton. The tacky adhesive on both sides of the inserts serves the purposes of securing the slip-lock inserts t o the two half-cartons and of thereby securing the two half-cartons one to another to form a dual half-carton unit—i.e., a full carton structure. FIG. 4 shows a side view of the dual half-carton unit with the two half-cartons 3 and 3' secured together by the slip-lock insert. FIG. 7 shows a vertical cross-sectional view of the dual half-carton unit with a slip-lock insert at each end.

When two half-cartons, each containing five 20 cigarette packs in a 1×5 pack side-by-side configuration, are securely adhered and paired together in this fashion, a full carton containing ten cigarette packs in the standard 2×5 pack carton configuration is formed. These two half-cartons may then be tax-stamped together as a single 2×5 pack unit in existing tax-stamping machines. After tax stamping, at the retail level, a consumer has the option of purchasing the two half-cartons as a full ten-pack carton of cigarettes or of separating the two half-cartons and purchasing only one five-pack half-carton.

Figure 6:
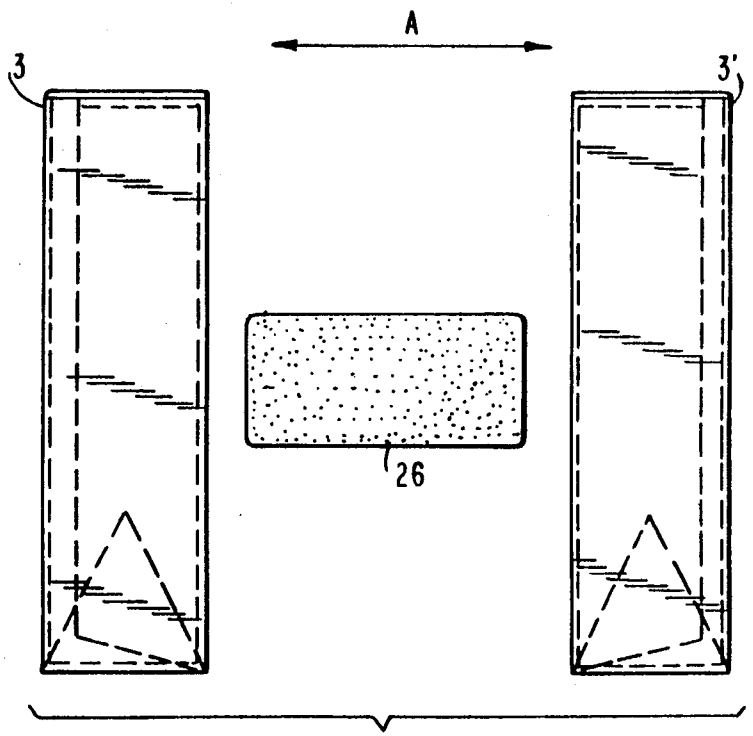
FIG. 6 shows a side elevational view of two half-cartons fully separated, with an unattached releasable attachment means between them.
Figure 5:
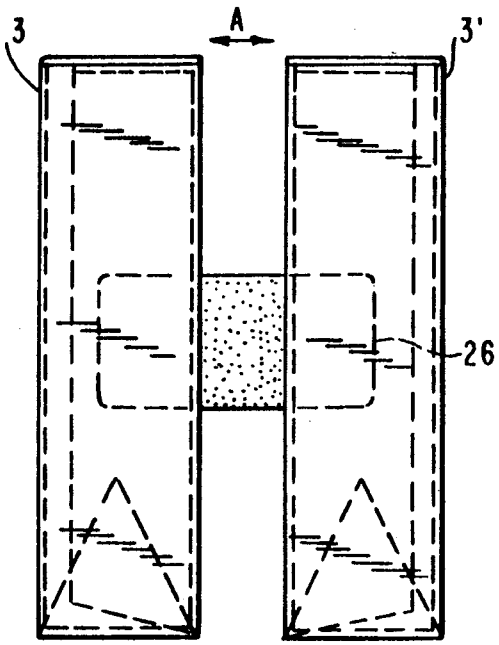
FIG. 5 shows a side elevational view of two half-cartons attached by two releasable attachment means, partially separated.

FIGS. 5 and 6 show two stages of the separation of the two half-cartons from each other. FIG. 5 shows two half-cartons 3 and 3' partially separated, having been pulled in the directions indicated by arrows A. Because the slip-lock insert 26 is not permanently glued to either half-carton 3 or 3', its tacky surfaces (or whatever alternative releasable attachment means is provided) will release their hold on the half-cartons so that they may be separated. When the two half-cartons 3 and 3' are further pulled apart and completely separated, as shown in FIG. 6, the slip-lock insert 26 is removed completely and discarded. The side walls and side flaps of the half-cartons remain glued to each other even after removal of the slip-lock insert. Each of the two half-cartons may then be sold separately as a half-carton unit of cigarettes.

Thus, a method of attaching two half-cartons, and the resulting full carton, are provided. One skilled in the art will appreciate that the present invention can be practiced by other than the described embodiments, which are presented for purposes of illustration and not of limitation, and the present invention is limited only by the claims that follow.

What is claimed is:

1. A method of packaging two containers, comprising the steps of:

forming two substantially identical containers, each container having a front wall, two side walls and two side flaps;

forming a dual container structure by positioning the two containers so that the front wall of one container abuts the front wall of the other container;

placing a releasable attachment means at an end of the dual container structure at least partially between the side flap and side wall of each container; and permanently adhering the side walls of each respective container to the side flaps of each respective container while releasably securing the releasable attachment means to at least one of (a) the side walls and (b) the side flaps.

2. The method of claim 1 wherein the step of placing a releasable attachment means comprises placing a releasable attachment means at each end of the dual container structure.

3. The method of claim 1, wherein the step of forming two substantially identical containers comprises the steps of:

providing two substantially identical container blanks, each container blank having sections separated from each other by a scored fold line; and folding the two blanks along the score lines to form two containers, each container having a front wall and a back wall of substantially the same size, a bottom wall with two bottom flaps, at least one top flap, two side flaps and two side walls.

4. The method of claim 1, wherein the step of forming two substantially identical containers comprises forming two substantially identical half-cartons.

5. The method of claim 1, wherein the step of placing a releasable attachment means comprises providing a paperboard section with two sides, each side having a pre-applied tacky adhesive.

6. The method of claim 5, wherein the providing step further comprises providing a tacky adhesive of a type suitable to hold the two containers together securely until they are pulled apart.

7. The method of claim 5, wherein the providing step comprises providing a paperboard section having rectangular shape, a width no greater than twice that of the side walls of two-half-cartons to be adhered and a height substantially smaller than that of the half-cartons to be adhered.

8. The method of claim 1, wherein the step of permanently adhering comprises gluing.

9. A detachable dual container structure, comprising:

two substantially identical containers, each container having a front wall, two side walls and two side flaps, wherein the two containers are positioned such that their front walls abut each other; and at least one releasable attachment means at least partially between, and releasably attached to at least one of (a) the side wall and (b) the side flap of each container at an end of the abutting two containers.

10. The structure of claim 9, comprising two releasable attachment means, one at each end of the abutting two containers at least partially between the side wall and side flap of each container.

11. The structure of claim 9, wherein each container comprises:

a front wall;

a back wall parallel to and substantially the same size as the front wall;

a bottom wall perpendicular to and connected to the front wall and the back wall;

two top flaps, one of which is horizontally attached to and pivotable along the top edge of the front wall and the other of which is horizontally attached to and pivotable along the top edge of the back wall;

two side flaps, each of which is vertically attached to and pivotable along one side edge of the front wall; and two side walls, each of which is vertically attached to and pivotable along one side edge of the back wall.

12. The structure of claim 9, wherein the two substantially identical containers comprise two substantially identical half-cartons.

13. The structure of claim 9, wherein the releasable attachment means comprises a paperboard section with two sides, each side having a tacky adhesive.

14. The structure of claim 13, wherein the paperboard section is rectangular in shape, with a width no greater than twice that of the side walls of two-containers to be adhered and a height substantially smaller than that of the containers to be adhered.

15. The detachable dual container structure described in claim 9, wherein the pre-applied tacky adhesive is of the type suitable to hold the two containers together securely until they are pulled apart.

* * * * *